US006311857B1

(12) United States Patent
Al-Darraji

(10) Patent No.: US 6,311,857 B1
(45) Date of Patent: Nov. 6, 2001

(54) STAND USING HOCKEY STICK SUPPORTS

(76) Inventor: Omar Al-Darraji, 10575 Bloomfield, Los Alamitos, CA (US) 90720

( * ) Notice: Subject to any disclaimer, the term of this patent is extended or adjusted under 35 U.S.C. 154(b) by 0 days.

(21) Appl. No.: 09/603,835

(22) Filed: Jun. 26, 2000

Related U.S. Application Data

(60) Provisional application No. 60/143,125, filed on Jul. 9, 1999.

(51) Int. Cl.[7] ..... A47F 5/00

(52) U.S. Cl. ..... 211/203; 211/85.3; 211/85.7; 248/431; 248/168

(58) Field of Search ..... 211/85.3, 85.7, 211/203, 189; 248/431, 164, 165, 163.1, 168; D6/552, 316

(56) References Cited

U.S. PATENT DOCUMENTS

D. 243,804 * 3/1977 Underwood et al. .
D. 362,755 * 10/1995 Ehrmann .
D. 385,127 * 10/1997 Affleck .
451,795 * 5/1891 Anderson .
1,437,256 * 11/1922 Martin .
1,561,371 * 11/1925 Strupe .
1,643,271 * 9/1927 Hansen .
1,896,446 * 2/1933 Goeller .
5,848,716 * 12/1998 Waranius ..... 211/85.7 X
6,073,783 * 6/2000 Allman ..... 211/85.3

* cited by examiner

*Primary Examiner*—Robert W. Gibson, Jr.

(57) ABSTRACT

A stand for supporting items, such as clothing or recreational equipment, is formed of three or four hockey stick-shaped supports, which are fastened to the sides of a block, with the curved striking surfaces at the top. If three supports are used, the block has a cross section of an equilateral triangle, and if four such supports are used, the block has a square cross section. Wells are formed on the top and bottom of each block, forming walls with a slightly arcuate slot formed in each wall at the top of the block. Bolts passing through the walls at the bottom of the block and the supports attach the supports to the block. Bolts passing through the supports and the slots at the top of the block assist in securing the supports to the block but permit the supports to pivot around the lower bolts by an amount permitted by the length of the slots. When the supports are held parallel to each other, the assembly is in position for storage or carrying. When the supports are pivoted to their opposite position, they become spaced legs holding the stand upright above a supporting surface such that various items can be hung on or from the striking surface, which may be perforated, e.g., for hangers. A bore may be drilled into the base of the top well for supporting a pole with a hockey puck-shaped member positioned above the level of the striking surfaces to provide an additional location for carrying a helmet or other object.

18 Claims, 8 Drawing Sheets

STAND USING HOCKEY STICK SUPPORTS

REFERENCE TO RELATED APPLICATION

This non-provisional application claims priority to provisional application Serial No. 60/143,125 filed Jul. 9, 1999. A co-pending design patent application, U.S. Ser. No. 29/107,670, was filed Jul. 9, 1999.

BACKGROUND OF THE INVENTION

This invention relates to stands for supporting various items of clothing and/or recreational equipment. There are many kinds of stands used for this purpose, from a simple post having hooks to fairly elaborate hall trees.

In connection with the game of ice or street hockey, there are clothing items, such as helmets, jerseys and pants, pads of various kinds, and the hockey skates or roller blades, all of which must, at times, be temporarily stored. Anyone having a child or teenaged hockey player in the house is well aware of the clutter such items can create if not properly stored.

It is an object of the present invention to provide a unique and attractive stand which can be used to support the various items of hockey equipment and clothing and which can provide some motivation for the hockey player to hang up his or her various items of clothing and equipment.

It is another object of the present invention to provide such a stand, which is readily portable and which can be easily stored when not in use.

SUMMARY OF THE INVENTION

In meeting the above objectives, applicant has provided a unique stand formed of three or four support members in the form of actual hockey sticks, or simulations thereof, which are pivotally attached to a block in such a way as to permit the hockey sticks, when in one position, to be spread to provide support for the stand, and when in another position, to be essentially parallel to each other for transport or storage. The handle ends of the hockey sticks stand on the floor and the curved striking ends spread away from each other to provide arms or supports for hanging the items referred to above. Many hockey sticks include, on their curved ends, a series of holes which may be useful for attaching clothes hangers.

The block, which may be either square or triangular in cross-section, depending upon whether four or three hockey sticks are used, includes a four or three-sided well at its top end, thereby providing a shallow wall at the top of each face of the block. A slightly arcuate slot is cut in each wall and a bolt passes through each hockey stick and the slot and is secured on the inside of the wall. The slot limits the pivoting movement of the hockey sticks to a small angle sufficient to provide an adequate base for the stand. When the hockey sticks are pivoted to the opposite end of the slot, they line up parallel with each other for storage or for carrying the stand.

In one embodiment, a hole is drilled, centrally of and parallel to, the sides of the block in the bottom of the well. A rod is inserted into the hole with a cylindrical member in the shape of a hockey puck attached to the top of the rod. The puck-like member is thereby elevated significantly above the curved ends and is useful, in particular, for storing a helmet.

The stand of this invention has sufficient storage capacity that it may be used in retail establishments, for example, to hang as many as 20 shirts or other garments on hangers from the holes in the blades of the hockey sticks. The hockey puck at the top may be used to mount appropriate signs.

BRIEF DESCRIPTION OF THE DRAWINGS

This invention may be better understood from the following detailed description with reference to the drawing in which.

DETAILED DESCRIPTION OF THE PREFERRED EMBODIMENTS

Figure 1:
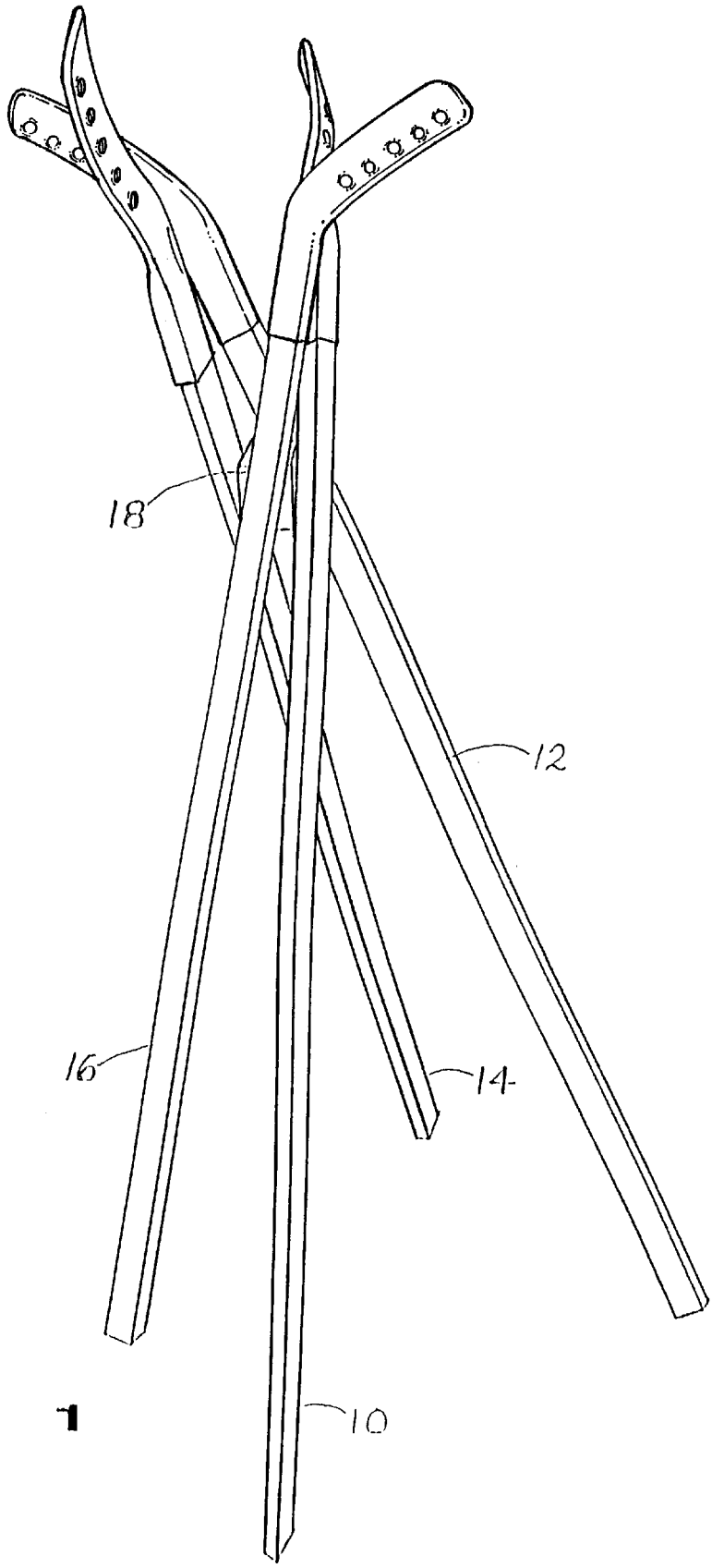
FIG. 1 is a perspective view of a four-leg hockey stick stand according to the invention.

FIG. 1 is a perspective view of a hockey stick stand according to my invention. This stand includes four hockey sticks 10, 12, 14, and 16 all pivotally secured to a block 18. Each hockey stick includes an elongated handle section and a curved blade section, the blade sections being numbered 20, 22, 24, and 26, respectively.

Figure 2:
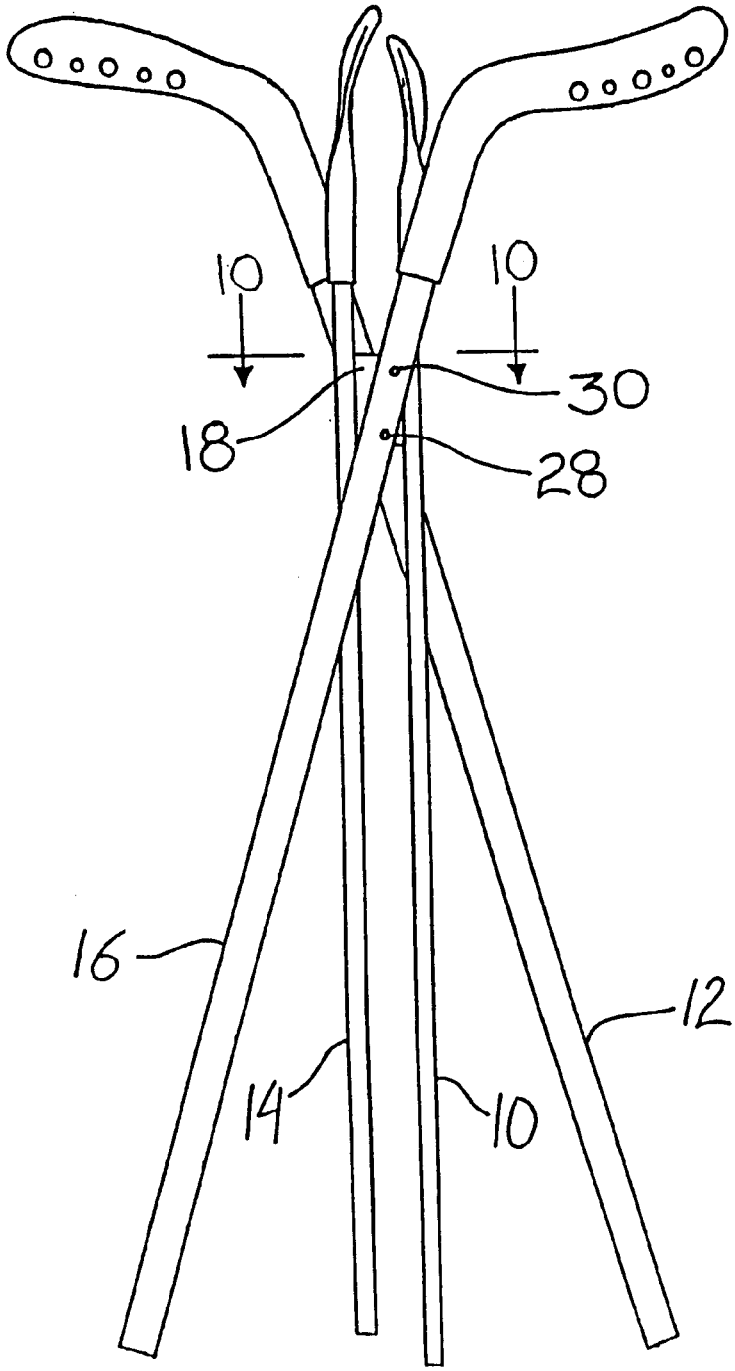
FIG. 2 is a side elevational view of the stand of FIG. 1.
Figure 3:
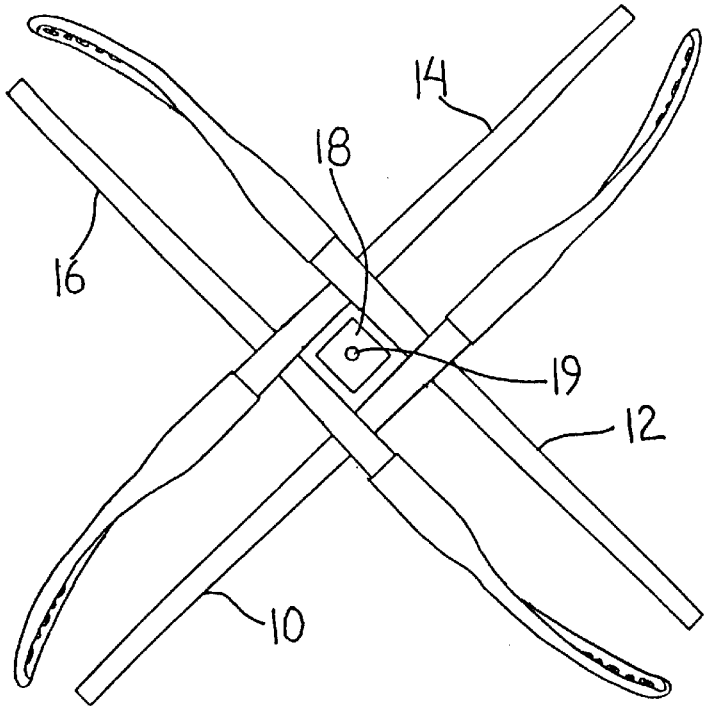
FIG. 3 is a top view of the stand of FIG. 1.
Figure 4:
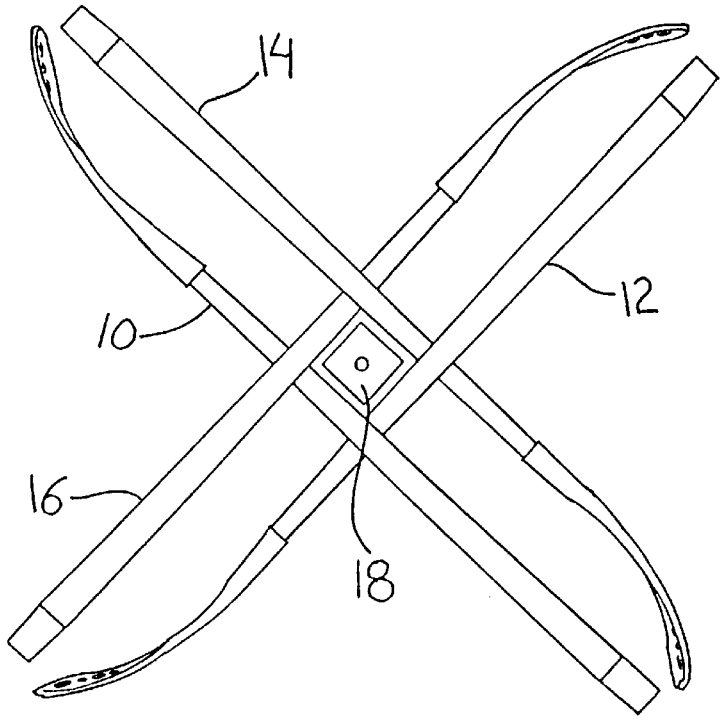
FIG. 4 is a bottom view of the stand of FIG. 1.

Now referring to FIG. 2, in connection with FIGS. 3 and 4, it will be apparent that block 18 has a square cross section. The handles of sticks 10, 12, 14, and 16 are wider than they are thick, with their wide sides pivotally secured to block 18. In FIG. 2 hockey sticks 12 and 16 have their wide sides parallel with the plane of the paper, while sticks 10 and 14 have their wide sides perpendicular thereto. Stick 16 is shown secured to block 18 by two bolts 28 and 30. Bolt 28 is a pivot bolt and hockey stick 16 pivots around bolt 28 within a range limited by bolt 30 which moves in a slot in block 18, discussed below in connection with FIG. 11. The other hockey sticks 10, 12, and 14 are secured to block 18 by identical means.

FIG. 3 is a top view of the stand of FIGS. 1 and 2. The square cross section of block 18 is apparent in this view. Each of hockey sticks 10, 12, 14, and 16 are secured to a side of block 18, and each is movable in a plane parallel to the side of the block 18 to which it is attached.

FIG. 4 is a bottom view of the stand of FIGS. 1–3.

Figure 5:
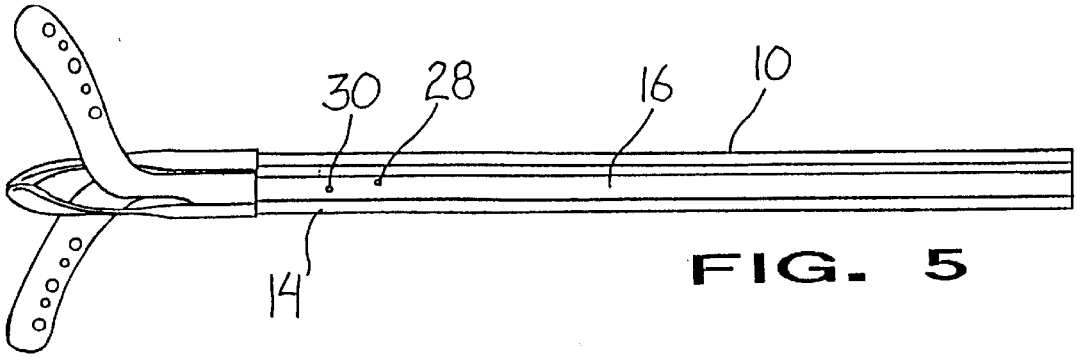
FIG. 5 is a side view of the stand of FIG. 1 as folded for transport or storage.

FIG. 5 is a side view of the hockey stick stand of FIGS. 1–4 with the individual sticks each rotated to a position where the straight portions are parallel with each other. This position is useful for carrying the stand or for storing it.

Figure 6:
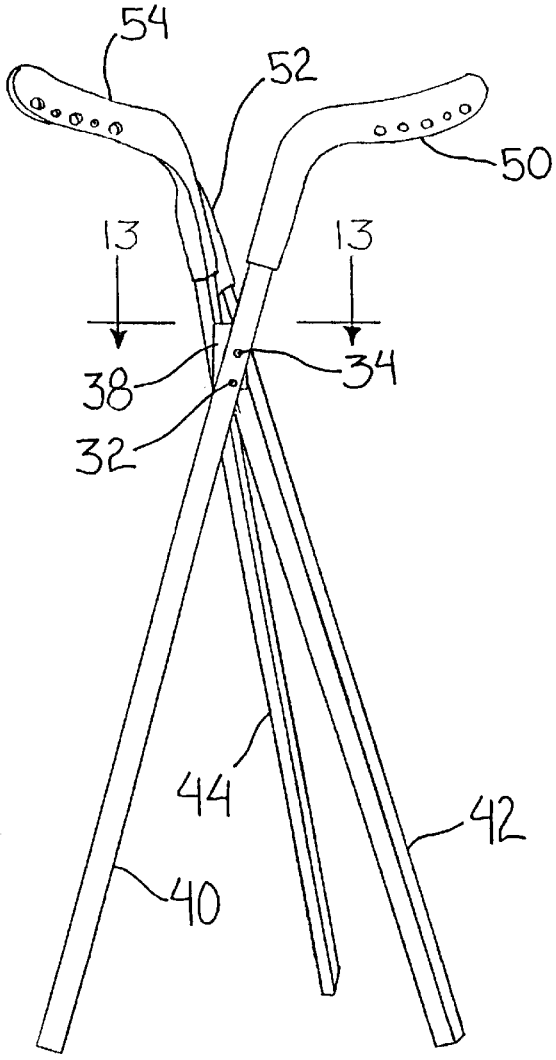
FIG. 6 is a perspective view of an alternate embodiment of this invention.

FIG. 6 is a perspective view of an alternate embodiment of our hockey stick stand using three hockey sticks rather than four. Three sticks 40, 42, and 44 represent the minimum number of legs for stability, but the four-leg version of FIGS. 1–5 is the preferred embodiment. In the FIG. 6 embodiment, the block 38 to which the sticks are attached has a cross section which is in the form of an equilateral triangle, rather than a square (see FIG. 7). Hockey sticks 40, 42, and 44 are attached to the sides of block 38 and include curved striking ends 50, 52 and 54 respectively. Hockey stick 40 is shown secured to block 38 by means of bolts 32 and 34, one of which, 32, is a pivot bolt and the other, bolt 34, serves to limit the pivot range of stick 40, as discussed below.

Figure 7:
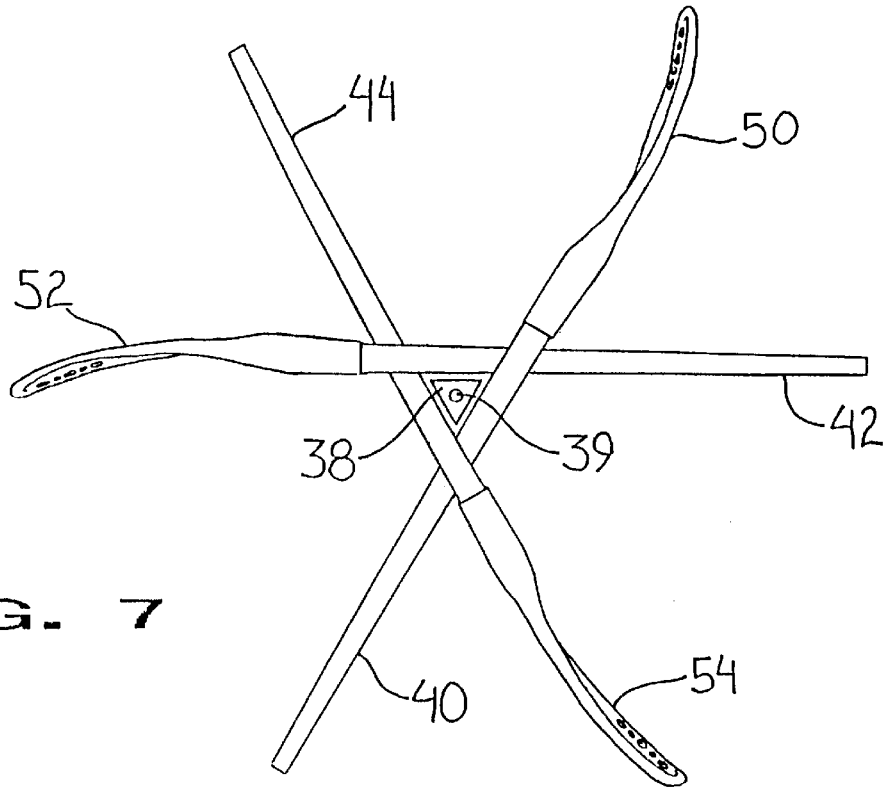
FIG. 7 is a top view of the stand of FIG. 6.

FIG. 7 is a top view of the hockey stick stand of FIG. 6 and clearly shows the triangular cross section of block 38 with hockey sticks 40, 42, and 44 secured to block 38.

Figure 8:
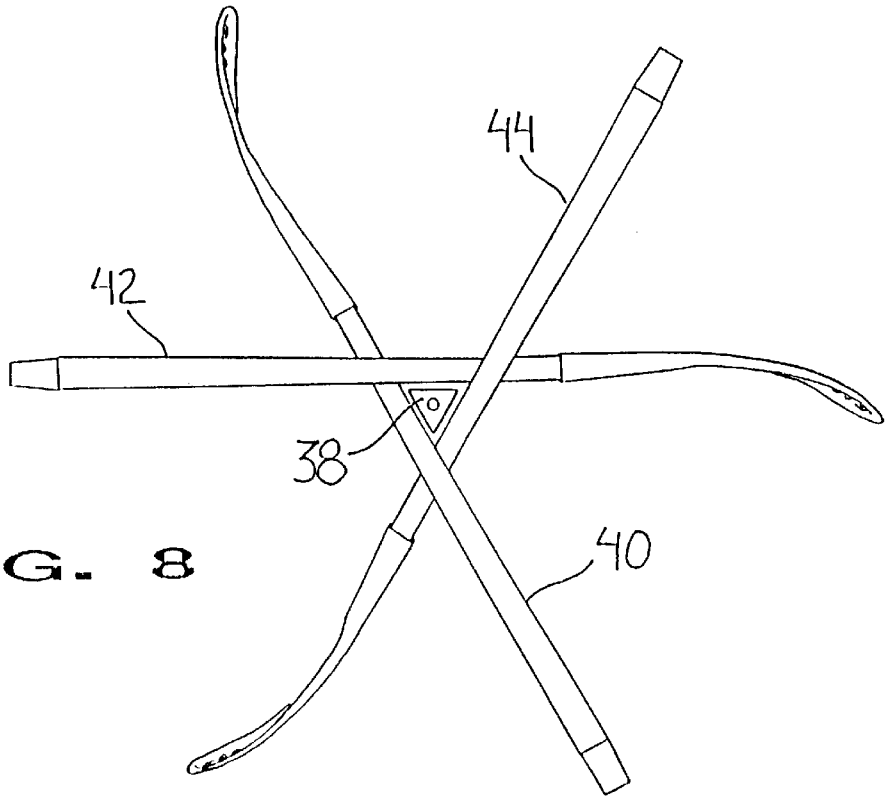
FIG. 8 is a bottom view of the stand of FIG. 6.
Figure 13:
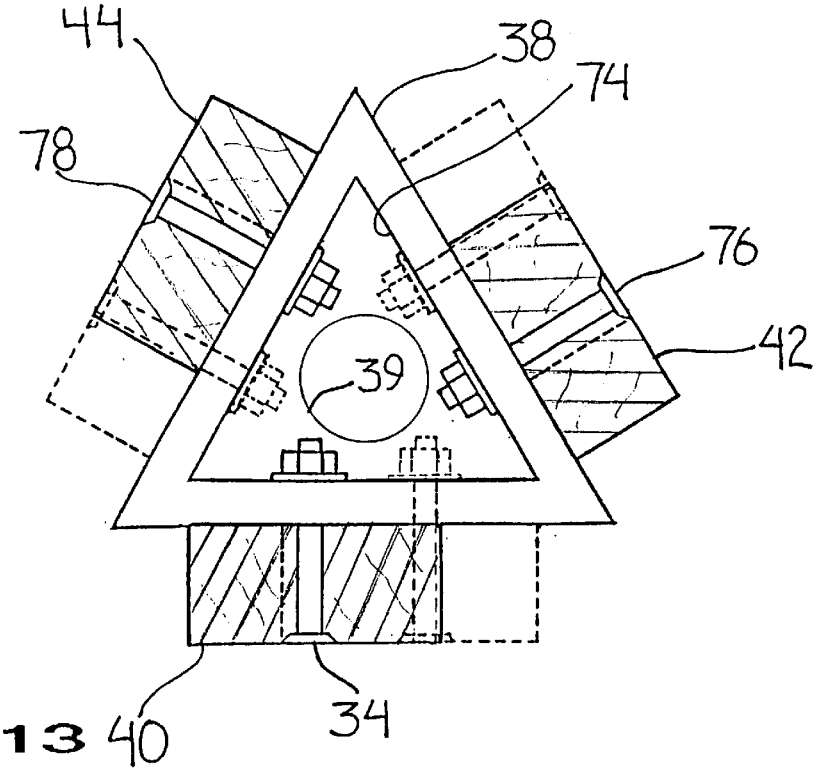
FIG. 13 is a sectional view taken along line 13—13 of FIG. 6.

FIG. 8 is a bottom view of the stand of FIGS. 6 and 7. A well 74 of FIG. 13 is present to accommodate the bolts 34, 76, and 78 for hockey stick legs 40, 42 and 44.

Figure 9:
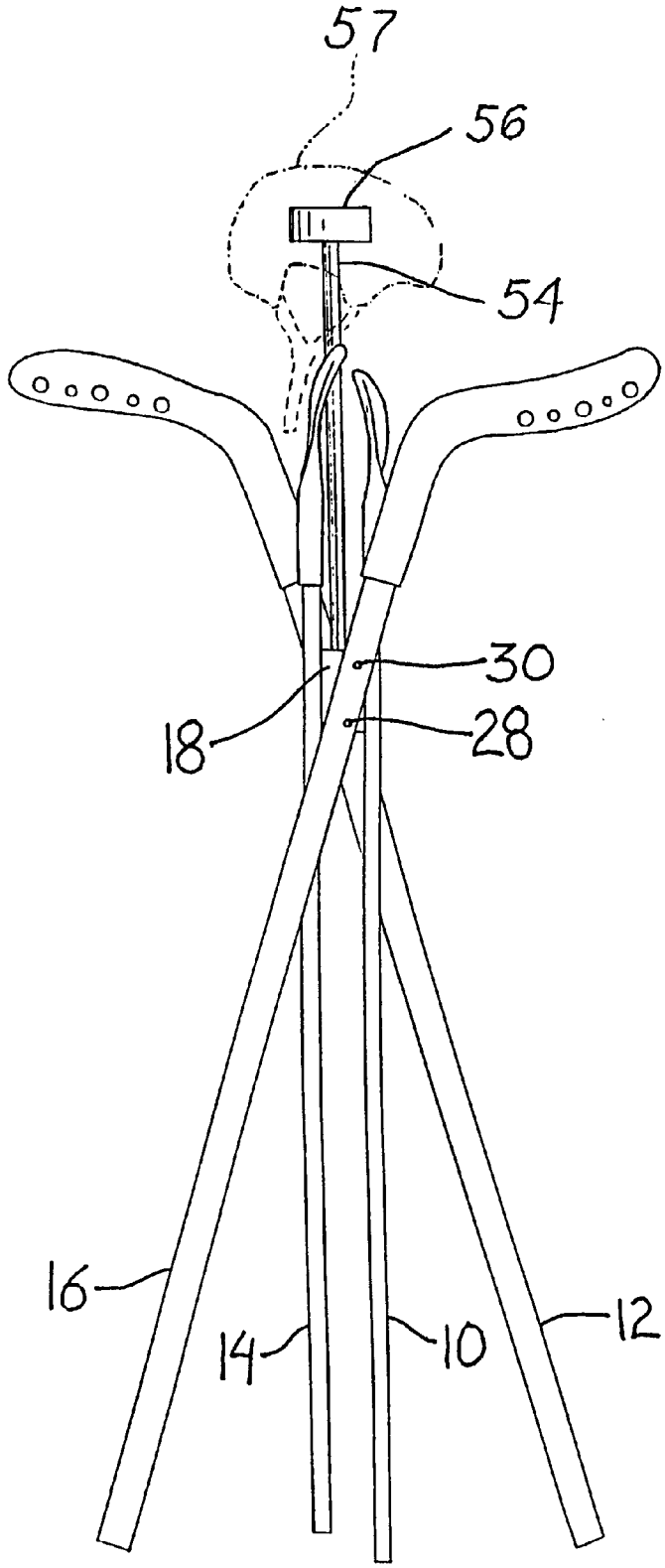
FIG. 9 is a side elevational view of an alternate embodiment of the stand of FIG. 1 showing a helmet in phantom stored on the stand.

FIG. 9 is a side elevational view of a hockey stick stand similar to that shown in FIG. 2. All similar parts are given the same numerals. It will be observed that in FIGS. 3 and 4, the block 18 includes an axial or central bore 19. A similar bore 39 is shown in block 38 of FIG. 7. The purpose of the bore in each block, is to receive and carry a rod 54, which supports a cylindrical member 56 in the shape of a hockey puck as shown in FIG. 9. Member 56, which is spaced somewhat above the curved striking ends of the several hockey sticks, is intended as a means for receiving an additional item, such as a helmet 57. Users of the stand are certain to find other objects to hang on "puck" 56.

Figure 10:
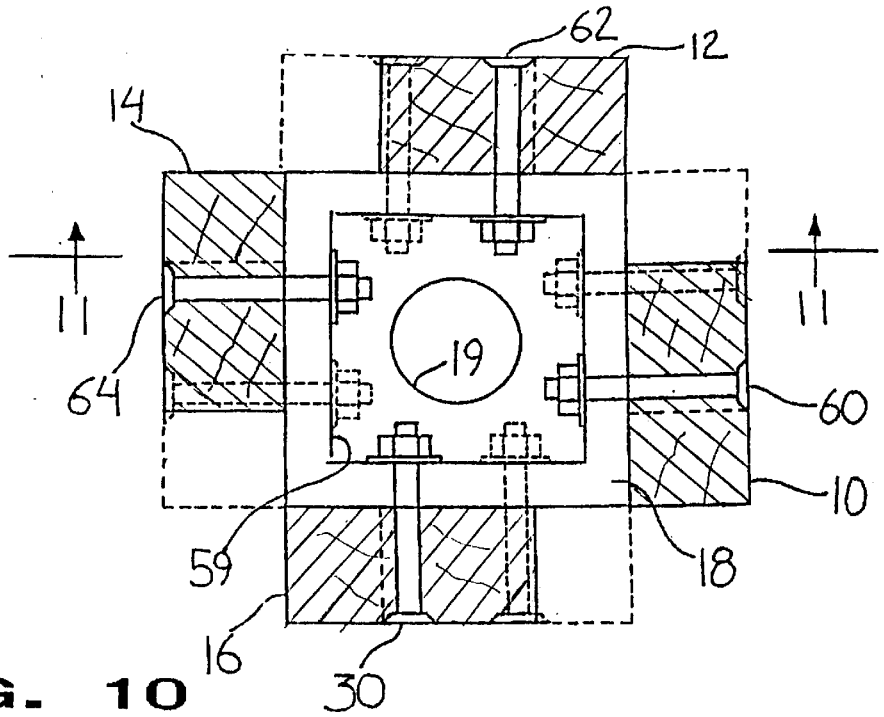
FIG. 10 is a sectional view on an enlarged scale taken along line 10—10 of FIG. 2.

FIG. 10 is a sectional view on an enlarged scale taken along line 10—10 of FIG. 2. In the top of block 18 is a well 59 of square cross section and centered in the well is bore 19. The well 59 leaves walls on each side of block 18. Hockey sticks 10, 12, 14, and 16 are secured to their respective walls by means of bolts 60, 62, 64, and 30. If desired, rod 54 and member 56 may be installed in bore 19.

Figure 11:
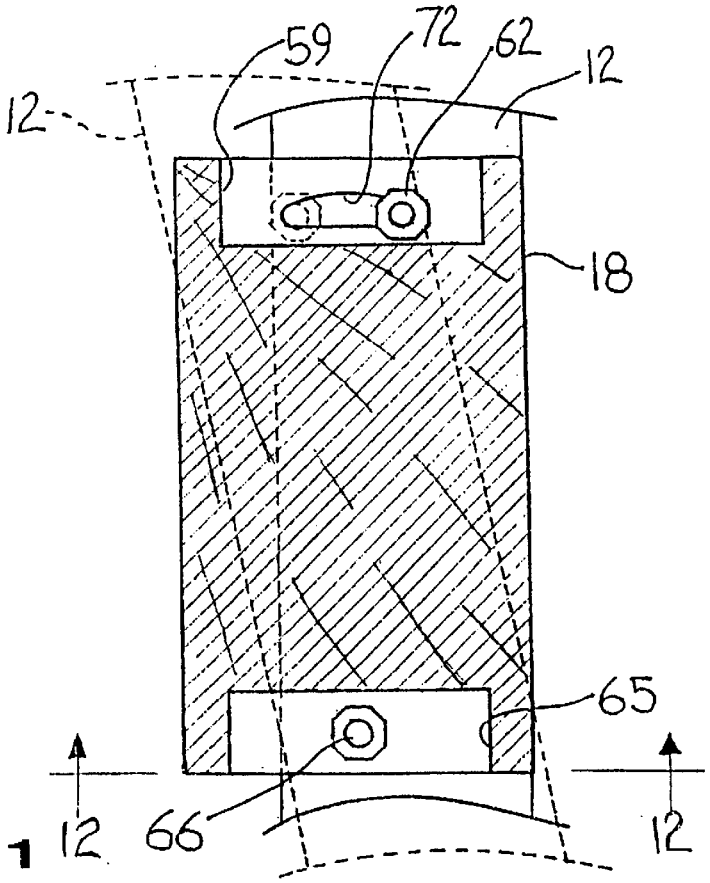
FIG. 11 is a sectional view taken along line 11—11 of FIG. 10.

FIG. 11 is a sectional view taken along line 11—11 of FIG. 10. In this view, it will be seen that bolt 62 passes through hockey stick 12 and slot 72 in the wall of well 59. At the lower end of block 18 is another well 65 to which hockey stick 12 is secured by means of a bolt 66. Hockey stick 12 rotates around bolt 66 and is constrained in the amount of its rotational movement by bolt 62, which is carried by stick 12 only as far as permitted by slot 72. This movement is indicated in FIG. 11 by the alternate position of hockey stick 12 shown in dotted outline, and in FIG. 10 by the alternate positions of hockey sticks 10, 12, 14, and 16 shown in dotted outline. In the alternate positions, the hockey sticks are spread to make the stand self-supporting and to enable it to carry a load of clothing, helmets, skates, or roller blades etc.

Figure 12:
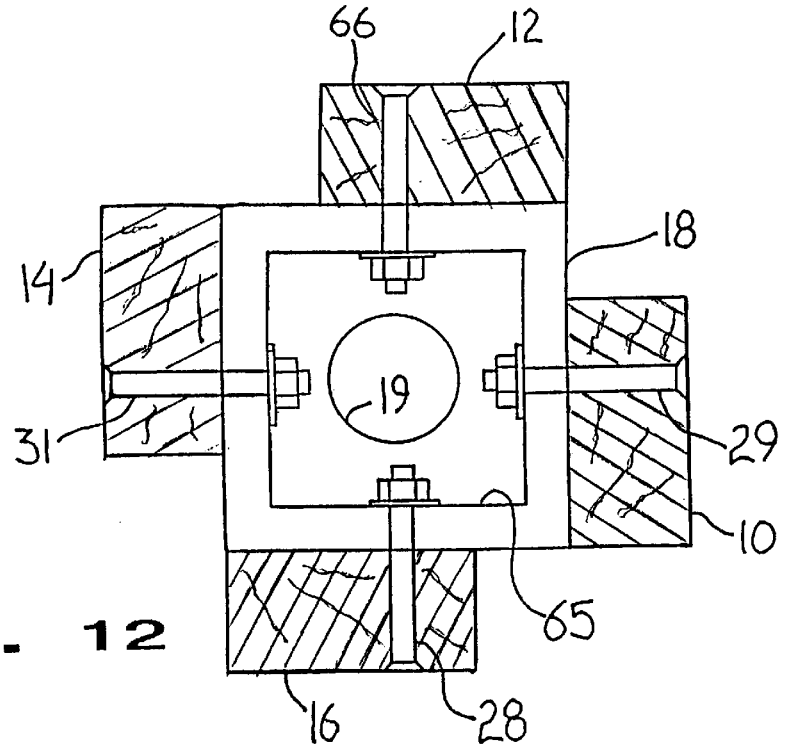
FIG. 12 is a bottom plan view partly inside of the block and stick assembly taken along line 12—12 of FIG. 11.

FIG. 12 is a bottom plan view, partly in section, taken along line 12—12 of FIG. 11. A well 65 of square cross section formed in the lower end of block 18 creates walls through which pass bolts 28, 29, 66, and 31 pivotally securing hockey sticks 16, 10, 12, and 14, respectively, to block 18.

FIG. 13 is a top plan view, partly in section, on an enlarged scale, taken along line 13—13 of FIG. 6. In the top of block 38 is a well 74 of triangular cross section and centered in the well 74 is a bore 39 for receiving rod 54. Well 74 leaves walls on the three sides of block 38. Hockey sticks 40, 42, and 44 are secured to their respective walls by means of bolts 34, 76, and 78, and their missing pivot limiting bolts, which are shown in dashed lines. The walls in the top of block 38 include slots essentially the same as those in block 18 and alternate positions of hockey sticks 40, 42, and 44 are shown in dotted outline, similarly to FIG. 10. Block 38 includes a lower well similar to that of block 18 creating walls to which bolt 32 (FIG. 6) and other bolts are secured for pivotally securing hockey sticks 40, 42 and 44 to block 18.

Either of these stands exhibits sufficient utility and attractiveness for either home or retail store use. The attractive features are the subject of the co-pending design patent application, referenced above.

The pivoting mechanism of FIGS. 10–13 represent the best mode known to me as of the date of filing of the application for patent. Of course, other mechanisms may also work or the stand may be fixed where compactness for storage is not a factor.

The above-described embodiments of the present invention are merely descriptive of its principles and are not to be considered limiting. The scope of the present invention instead shall be determined from the scope of the following claims including their equivalents.

What is claimed is:

1. A stand for supporting various articles of clothing or recreational equipment above a supporting surface comprising a plurality of support members each in the shape of a hockey stick, a block and fastening means securing said support members to said block, each of said support members including a blade end and a straight handle, with the blade ends of said hockey sticks positioned uppermost and the ends of the handles comprising the support of the stand;

said support members being pivotable between angled positions relative to each other to provide spaced legs to support said stand and parallel positions for transport and storage of said stand;

said fastening means including said block, fasteners securing said block to said support members and additional fasteners secured to said block cooperating with said support members to limit said angled positions.

2. A stand as claimed in claim 1 wherein said block is square in cross section having four sides and four of said support members are secured to said sides.

3. A stand as claimed in claim 1 wherein said block is triangular in cross section having three sides and three of said support members are secured to said sides.

4. A stand for supporting various articles of clothing or recreational equipment above a supporting surface comprising a plurality of support members each in the shape of a hockey stick, a block and fastening means securing said support members to said block, each of said support members including a blade end and a straight handle, with the blade ends of said hockey sticks positioned uppermost and the ends of the handles comprising the support of the stand;

said block having an upwardly facing surface, a well formed in said upwardly facing surface creating a wall in each of said sides, a slot formed in each of said walls and said fastening means is secured to each of said support members through said slot thereby permitting said support members to pivot between a vertical position and an angled position relative to said block for supporting said stand.

5. A stand as claimed in claim 4 wherein said fastening means comprise bolts secured to said block and to said support members.

6. A stand as claimed in claim 4 wherein said block is square in cross section having four sides and four of said support members are secured to said sides.

7. A stand as claimed in claim 4 wherein said block is triangular in cross section having three sides and three of said support members are secured to said sides.

8. A stand as claimed in claim 1 wherein said block has an upwardly facing surface, a vertical bore extends into said block from said surface, and a vertical support rod is carried in said bore.

9. A stand as claimed in claim 8 wherein an enlarged member constituting a support for helmets and like is attached to the top of said rod.

10. A stand adapted to sit on a supporting surface comprising a block having a plurality of sides, a plurality of support members, a plurality of fasteners, each of said support members in the shape of a hockey stick and each pivotally secured by means of a first group of said fasteners to one of the sides of said block, each of said support members including a striking end and a straight handle with the ends of said handles adapted to contact said supporting surface and said striking ends being positioned above said block, and other fasteners operatively connected between said block and said support members for limiting the pivotal movement of said support members.

11. A stand as claimed in claim 10 wherein said support members are pivotable on said first group of fasteners between angled positions relative to each other to provide spaced legs to support said stand and parallel positions for transport and storage of said stand.

12. A stand as claimed in claim 11 wherein said block has an upwardly facing surface, a well is formed in said upwardly facing surface creating a wall in each of said sides, a slot is formed in each of said walls and said other fasteners are secured to each of said support members through said slots thereby permitting said support members to pivot between a vertical position and an angled position relative to said block for supporting said stand.

13. A stand as claimed in claim 12 further comprising a downwardly facing surface on said block, a well formed in said downward facing surface creating a wall in each of said sides, and said first group of fasteners are secured to each of said support members around which each of said support members pivot.

14. A stand as claimed in claim 12 wherein said other fasteners comprise bolts secured to said block and to said support members.

15. A stand as claimed in claim 12 wherein said block is square in cross section having four sides and four of said support members are secured to said sides.

16. A stand as claimed in claim 12 where in said block is triangular in cross section having three sides and three of said support members are secured to said sides.

17. A stand as claimed in claim 12 wherein a vertical bore extends into said block from the bottom of said well, and a vertical support rod is carried in said bore.

18. A stand adapted to sit on a supporting surface comprising a block having a plurality of sides, a plurality of support members, each of said support members in the shape of a hockey stick and each pivotally secured to one of the sides of said block, each of said support members including a striking end and a straight handle with the ends of said handles adapted to contact said supporting surface and said striking ends being positioned above said block, and stop means limiting the pivotal movement of said support members;

said support members being pivotable on pivotable support means between angled positions relative to each other to provide spaced legs to support said stand and parallel positions for transport and storage of said stand;

said stop means including an upwardly facing surface on said block, a well formed in said upwardly facing surface creating a wall in each of said sides, a slot formed in each of said walls and fastening means secured to each of said support members through said slot thereby permitting said support members to pivot between a vertical position and an angled position relative to said block for supporting said stand.

* * * * *